US007360545B2

(12) United States Patent
Ha

(10) Patent No.: US 7,360,545 B2
(45) Date of Patent: Apr. 22, 2008

(54) DISHWASHER

(75) Inventor: Jae Hoon Ha, Jinhae-si (KR)

(73) Assignee: LG Electronics Inc., Seoul (KR)

( * ) Notice: Subject to any disclaimer, the term of this patent is extended or adjusted under 35 U.S.C. 154(b) by 602 days.

(21) Appl. No.: 10/721,246

(22) Filed: Nov. 26, 2003

(65) Prior Publication Data

US 2004/0103927 A1 Jun. 3, 2004

(30) Foreign Application Priority Data

Nov. 28, 2002 (KR) ..... 10-2002-0074994

(51) Int. Cl.
*B08B 13/00* (2006.01)

(52) U.S. Cl. ..... 134/56 D; 134/57 D; 134/58 D; 134/113

(58) Field of Classification Search ..... 134/56 D, 134/57 D, 58 D, 113
See application file for complete search history.

(56) References Cited

U.S. PATENT DOCUMENTS

| | | | | | |
|---|---|---|---|---|---|
| 2,699,653 | A | * | 1/1955 | Ponsar | 405/96 |
| 3,874,403 | A | * | 4/1975 | Fischer | 137/386 |
| 4,025,237 | A | * | 5/1977 | French | 417/131 |
| 4,249,565 | A | * | 2/1981 | Brust | 137/495 |
| 4,352,371 | A | * | 10/1982 | Walters | 137/414 |
| 4,379,434 | A | * | 4/1983 | Thordarson | 116/228 |
| 4,814,752 | A | * | 3/1989 | Lehman | 340/616 |
| 4,838,303 | A | * | 6/1989 | Goans | 137/423 |
| 4,877,049 | A | * | 10/1989 | Fornasari | 137/312 |
| 5,650,564 | A | * | 7/1997 | Wodeslavsky et al. | 73/49.2 |
| 5,967,171 | A | * | 10/1999 | Dwyer, Jr. | 137/78.1 |
| 6,003,536 | A | * | 12/1999 | Polverari et al. | 137/15.08 |
| 6,135,142 | A | * | 10/2000 | Yokota et al. | 137/486 |
| 6,240,954 | B1 | * | 6/2001 | Bereznai | 137/312 |
| 6,336,469 | B1 | * | 1/2002 | Nixon et al. | 137/312 |
| 6,374,852 | B1 | * | 4/2002 | Olivas | 137/493.9 |
| 6,599,096 | B1 | * | 7/2003 | Totten et al. | 417/133 |
| 6,675,826 | B1 | * | 1/2004 | Newman et al. | 137/312 |
| 6,950,032 | B1 | * | 9/2005 | Hewitt et al. | 340/686.1 |
| 2004/0262552 | A1 | * | 12/2004 | Lowe | 251/11 |

FOREIGN PATENT DOCUMENTS

| | | | |
|---|---|---|---|
| DE | 31 33 349 | * | 3/1983 |
| DE | 34 30 639 | * | 3/1986 |
| DE | 36 04 673 | * | 8/1987 |

(Continued)

OTHER PUBLICATIONS

European Patent Office 0 071 831 Feb. 1983.*
European Patent Office 0 33 245 Mar. 1989.*
European Patent Office 0 683 263.*

*Primary Examiner*—Frankie L. Stinson
(74) *Attorney, Agent, or Firm*—Ked & Associates, LLP

(57) ABSTRACT

A dishwasher having an improved valve assembly is disclosed. The dishwasher includes a housing, a tub provided in the housing, an injector assembly for injecting water onto tableware positioned in the tub, and an inlet valve assembly. The inlet valve assembly includes a case installed at an inlet passage through which water is supplied to the tub. The case has an inlet opening which allows water to flow in, and an outlet opening which allows water to be discharged. A first valve selectively opens/closes a passage formed in the case, and a second valve closes the passage in the event a leak is detected.

39 Claims, 7 Drawing Sheets

FOREIGN PATENT DOCUMENTS

| | | | |
|---|---|---|---|
| DE | 36 44 053 | * | 6/1988 |
| FR | 2 752 249 | * | 8/1996 |
| GB | 2 166 645 | * | 5/1986 |
| GB | 2 225 934 | * | 6/1990 |

* cited by examiner

DISHWASHER

This application claims the benefit of Korean Application (s) No. 10-2002-0074994 filed on Nov. 28, 2002 which is/are hereby incorporated by reference.

BACKGROUND OF THE INVENTION

1. Field of the Invention

The present invention relates to a dishwasher, and more particularly, to a valve assembly for supplying water to a dishwasher.

2. Discussion of the Related Art

Generally, a dishwasher is an apparatus for cleaning tableware held therein by injecting water. An inlet passage connected to an external water supply source extends into a dishwasher to supply water, and an inlet valve assembly is installed at the inlet passage. Moreover, an outlet pump and an outlet passage are installed in the dishwasher to discharge the water.

Meanwhile, water may leak from various parts inside due to various reasons while the dishwasher operates. Specifically, it is highly probable that the water may leak from the inlet passage or the inlet valve assembly. For instance, the failure of the inlet valve assembly may excessively supply water to overflow from a tub. The water may keep leaking to flow in electric devices of the dishwasher, thereby causing failure or malfunctions to the electric devices or electric shock or fire due to a short circuit. Furthermore, if the water is not cut off by the inlet passage or the inlet valve assembly, the continuous leakage of water out of the dishwasher may extend to other electric home appliances, thereby causing failure of the home appliances or bringing about danger of electric shock or fire.

SUMMARY OF THE INVENTION

Accordingly, the present invention is directed to a dishwasher that substantially obviates one or more of the problems due to limitations and disadvantages of the related art.

An object of the present invention, which has been devised to solve the foregoing problem, lies in providing a dishwasher, by which further water leakage is prevented in case of water leakage.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a dishwasher including a housing, a tub in the housing to hold tableware, an injector assembly for injecting water on the tableware in the tub, and an inlet valve assembly including a case installed at an inlet passage for supplying the water to the tub, the case having an inlet opening via which the water flows in and an outlet opening via which the water is discharged, a first valve provided to the case to selectively open/close a passage in the case, and a second valve closing the passage in the case in case that the water leaks.

The first valve selectively opens/closes the inlet opening. And, the second valve closes the outlet opening.

The second valve includes a diaphragm installed at the passage and a pressing mechanism floated by the leaking water to press the diaphragm to close the passage.

And, the pressing mechanism includes a float configured to be floated by the leaking water and a plunger separated from the float to press the diaphragm if the float is floated.

Preferably, the plunger is attached to or detached from the float according to a distance from the float. For this, the pressing mechanism further includes a magnet detaching the plunger from the magnet according to a distance from the plunger in the case.

The float is guided by a guide provided on a base panel of the housing. And, the case includes a holder guiding a movement of the float.

The float includes a body floated by the leaking water and an extension member extending from the body to be adjacent to the plunger in the case.

The extension member includes a rod installed at the body and an arm extending from the rod to be adjacent to the plunger.

Preferably, the arm is movably installed at the rod and the magnet is installed at the arm.

Preferably, the rod includes a step supporting the arm. More preferably, the rod includes a plurality of steps to install the arm at a predetermined portion of the rod selectively.

Therefore, the present invention stops the additional leakage of the water, thereby preventing failure of the dishwasher and accident caused by a short circuit.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
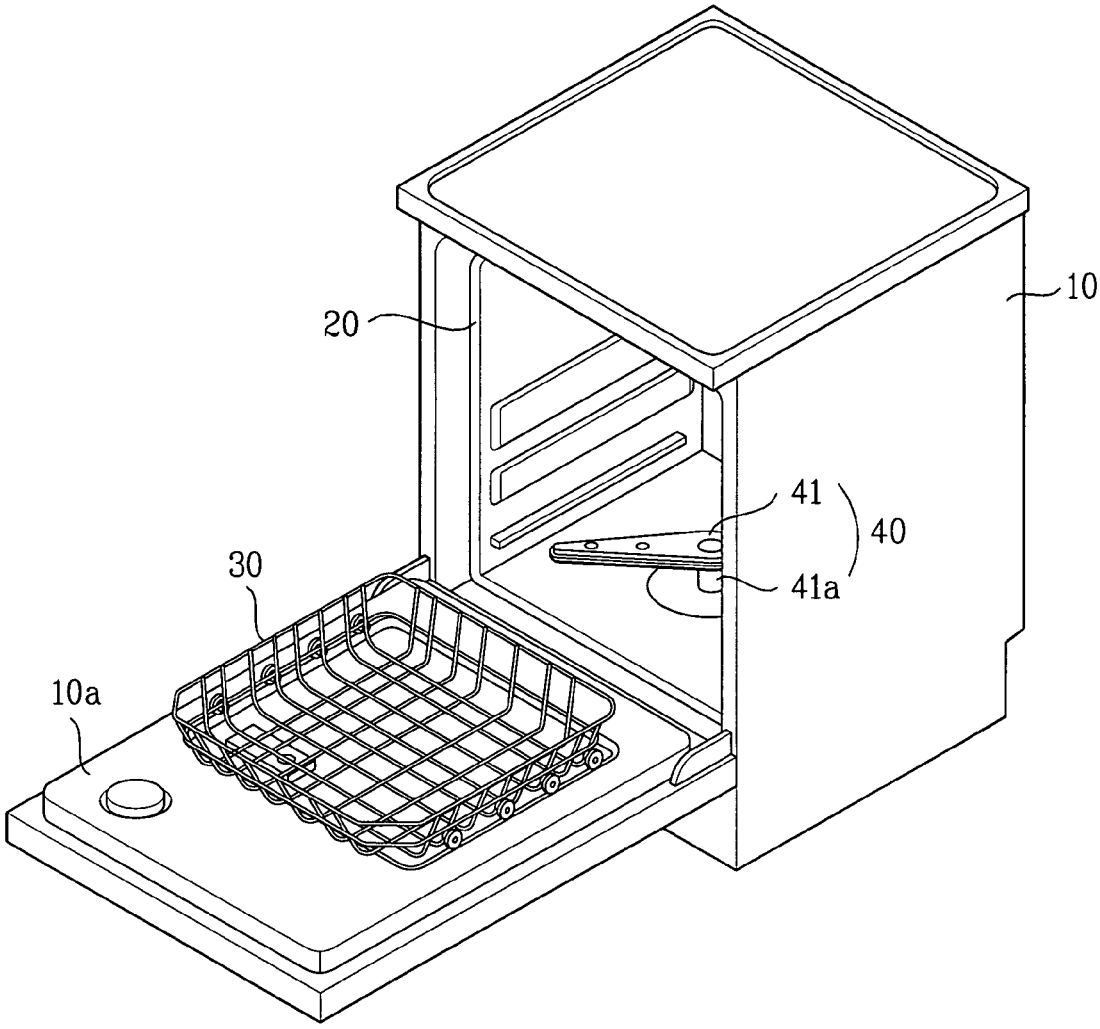
FIG. 1 is a perspective view of a dishwasher according to the present invention.
Figure 2:
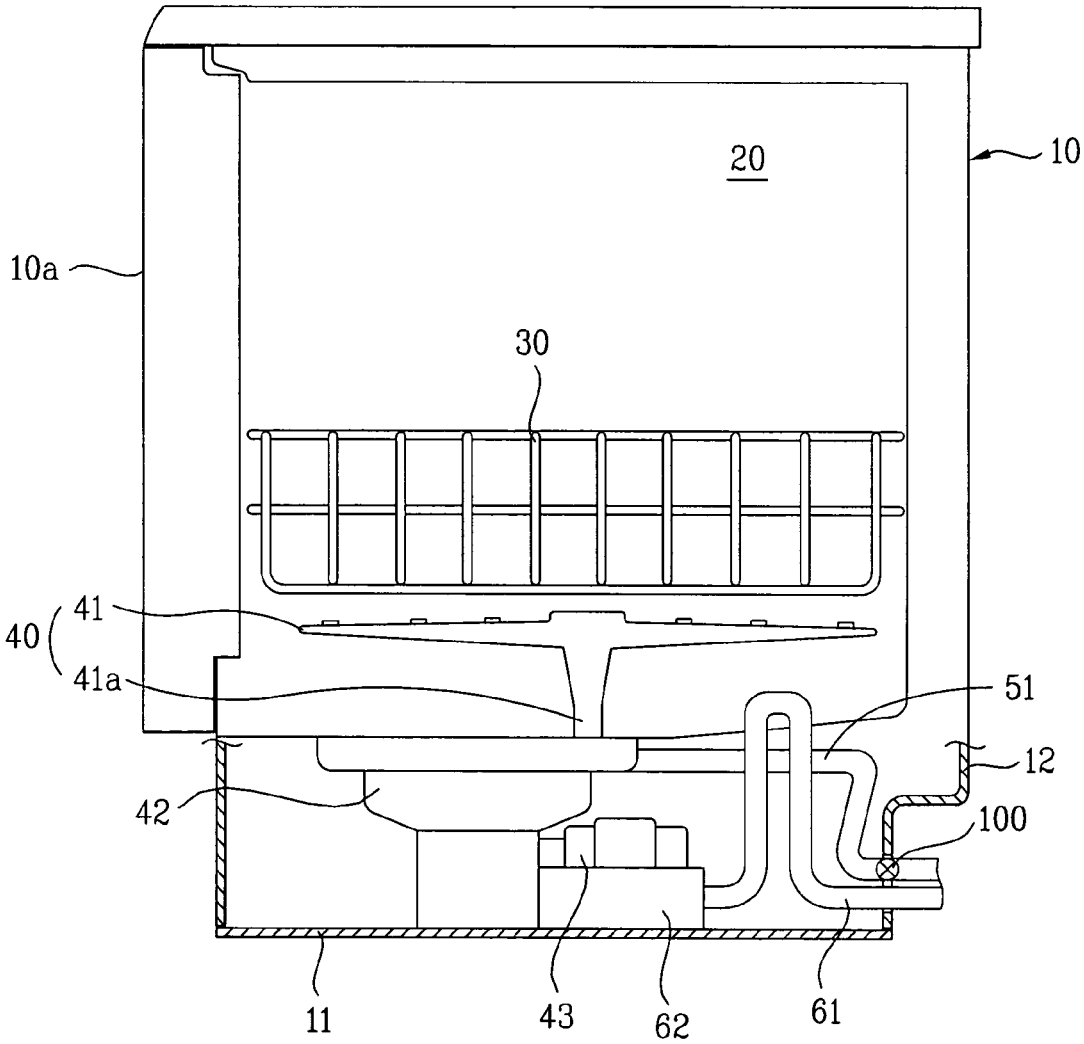
FIG. 2 is a cross-sectional view of a dishwasher according to the present invention.

FIG. 1 is a perspective view of a dishwasher according to the present invention and FIG. 2 is a cross-sectional view of a dishwasher according to the present invention.

Referring to FIG. 1 and FIG. 2, a dishwasher according to the present invention basically includes a housing 10 and a tub 20, a rack 30, and an injector assembly 40 installed in the housing 10.

The housing 10 is designed to install to protect various equipments inside. A door 11 is installed at a front side of the housing 10 to open/close an entrance of the tub 20 and a user puts or pulls tableware in or out of the tub 20 via the entrance. A fan (not shown) is installed at the door 10*a* to blow air for drying the washed tableware.

The tub 20 provides a space for holding the tableware to be washed. The rack 30 is installed in the tub 20 and a plurality of tableware are arranged on the rack 30 to leave a distance appropriate for washing. The rack 30 is constructed to enable to discharge water smoothly, and is detachably installed on a sidewall of the tub 20 to be conveniently put in or drawn out of the tub 20.

The injector assembly 40 is constructed to inject water onto the tableware. Specifically, the injector assembly 40 includes a nozzle 41 installed in the tub 20, a sump 42 communicating with the nozzle 41, and a pump 43. The nozzle 41 is connected to the sump 42 by a connecting pipe 41*a*. Preferably, the nozzle 41 is rotatably installed in the tub 20 to evenly inject the water on the tableware. The sump 42 is installed under the tub 20, and preliminarily stores the water to supply to the nozzle 41 uniformly. And, the pump 43 is installed in the vicinity of the sump 42, and pumps up the water in the sump 42 to the nozzle 41 for injection of the water.

Moreover, water supply equipment for supplying water to the sump 42 and drain equipment for discharging the used water are installed in the dishwasher. The water supply equipment includes an inlet passage 51 and a valve assembly 100 installed at the inlet passage 51. The inlet passage 51 is connected to the sump 42 and extends to an external water supply source through the housing 10. The valve assembly 100 selectively opens or cuts off the inlet passage 51. Once the valve assembly 100 is turned on, the water is supplied to the sump 42 from the water supply source via the inlet passage 51. Moreover, the drain equipment includes a drain passage 61 and a pump 62 communicating with the drain passage 61. Specifically, the drain passage 61 is connected to the sump 42, and extends outside the dishwasher via the pump 62. The water used in washing is stored in the sump 42 and is repeatedly injected onto the tableware by the injector assembly 40. After completion of washing, once the pump 62 is driven, the used water is discharged outside the dishwasher via the drain passage 61.

In order to prevent the failure and malfunction of the dishwasher due to the water leakage thereof, additional water leakage should be prevented. As explained in the foregoing description, the inlet valve assembly 100 selectively opens/closes the inlet passage 51, thereby substantially controlling the supply of water in the dishwasher. Hence, the inlet valve assembly 100 according to the present invention is configured to prevent the additional water leakage, and such an inlet valve assembly is explained in detail as follows.

Figure 3:
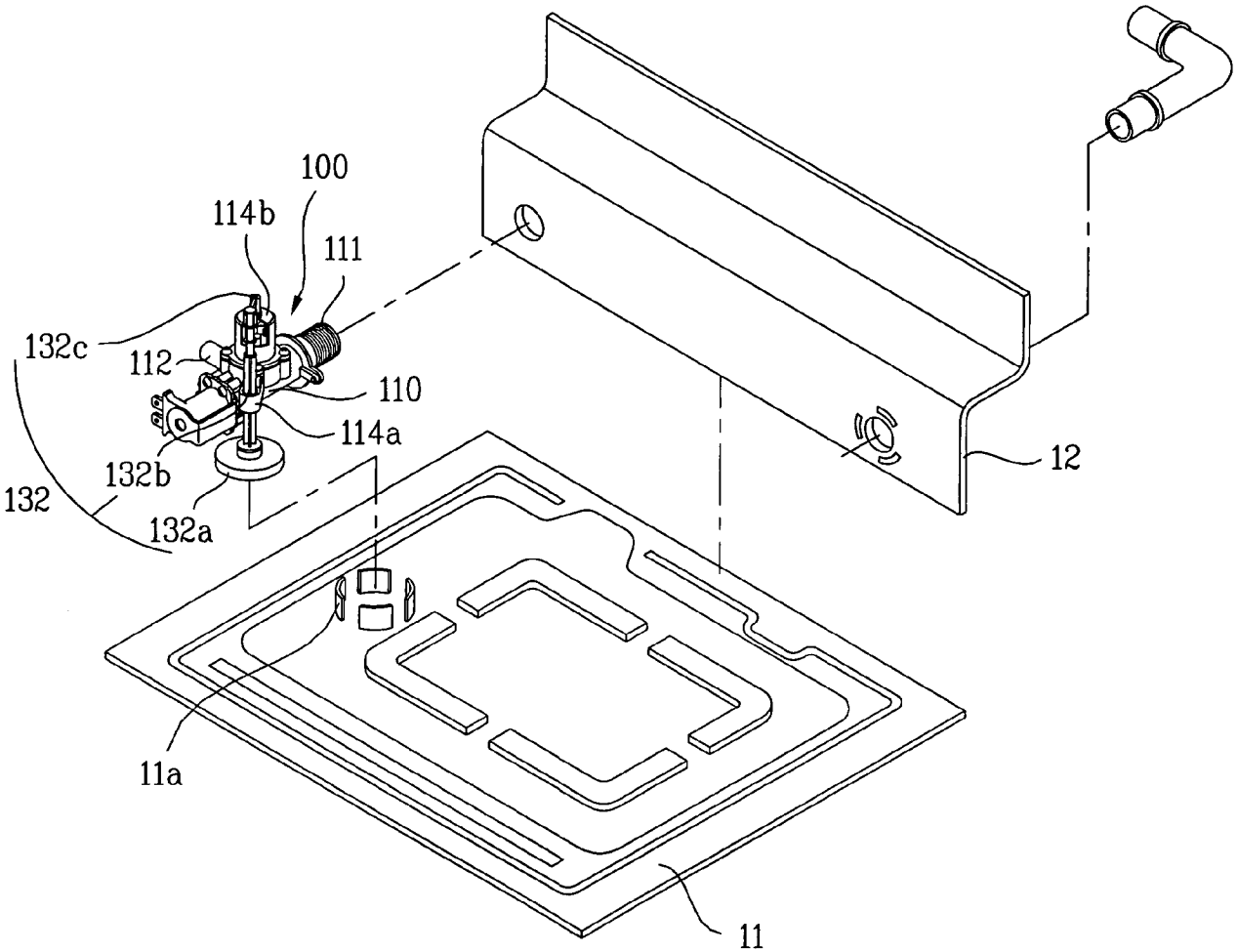
FIG. 3 is a perspective view of a disassembled inlet valve assembly of a dishwasher according to the present invention.
Figure 4:
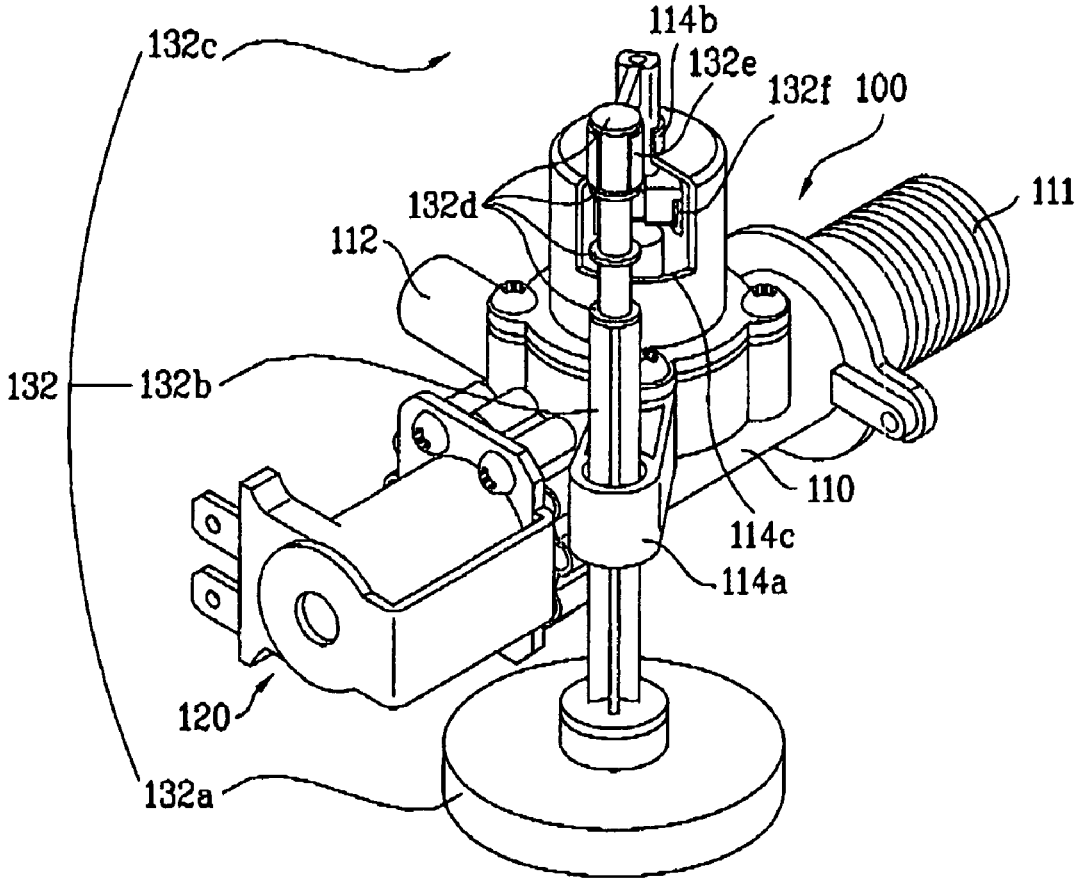
FIG. 4 is a perspective view of a dishwasher according to the present invention.
Figure 5A:
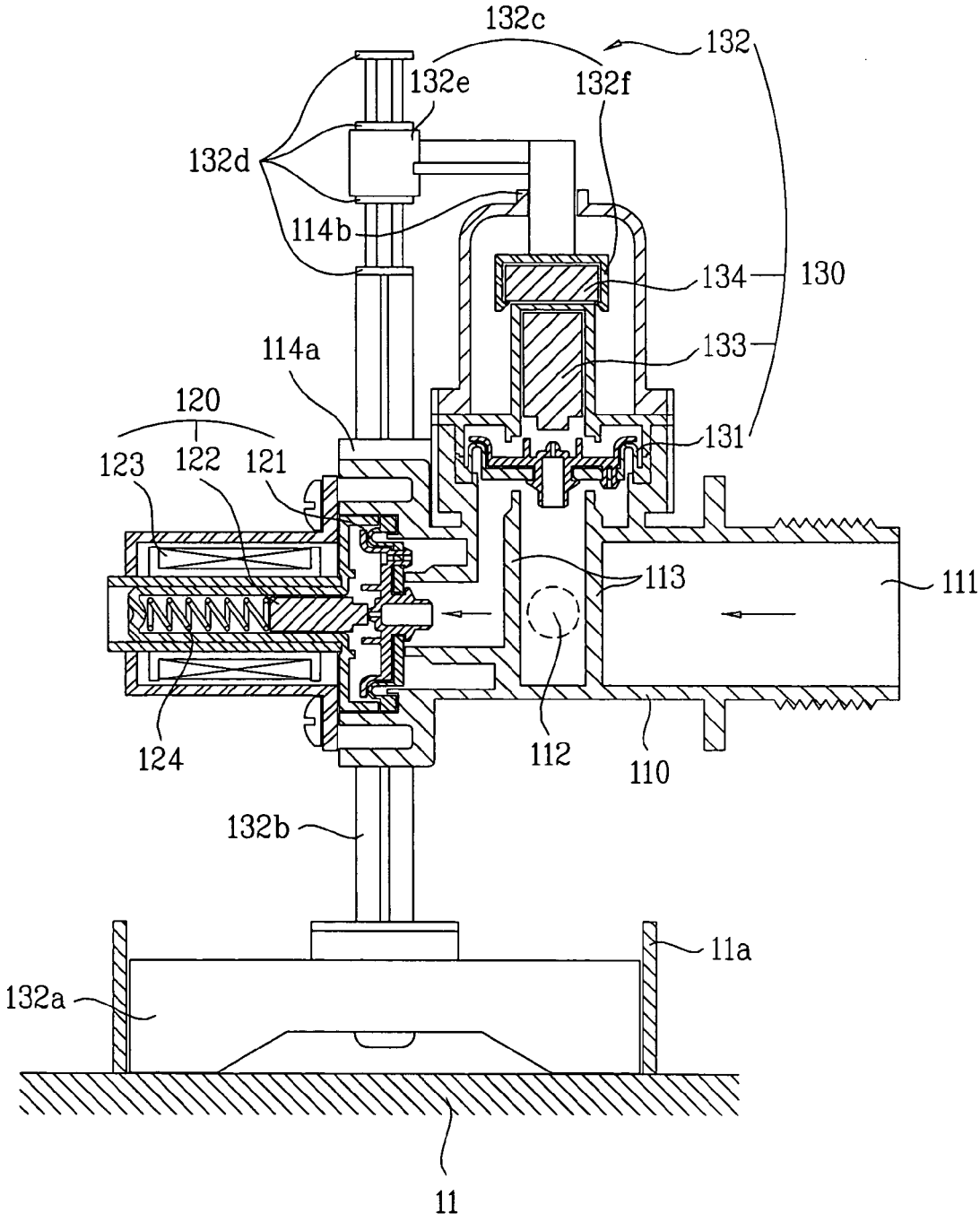
FIGS. 5A~5C are cross-sectional views of a dishwasher according to the present invention.
Figure 5B:
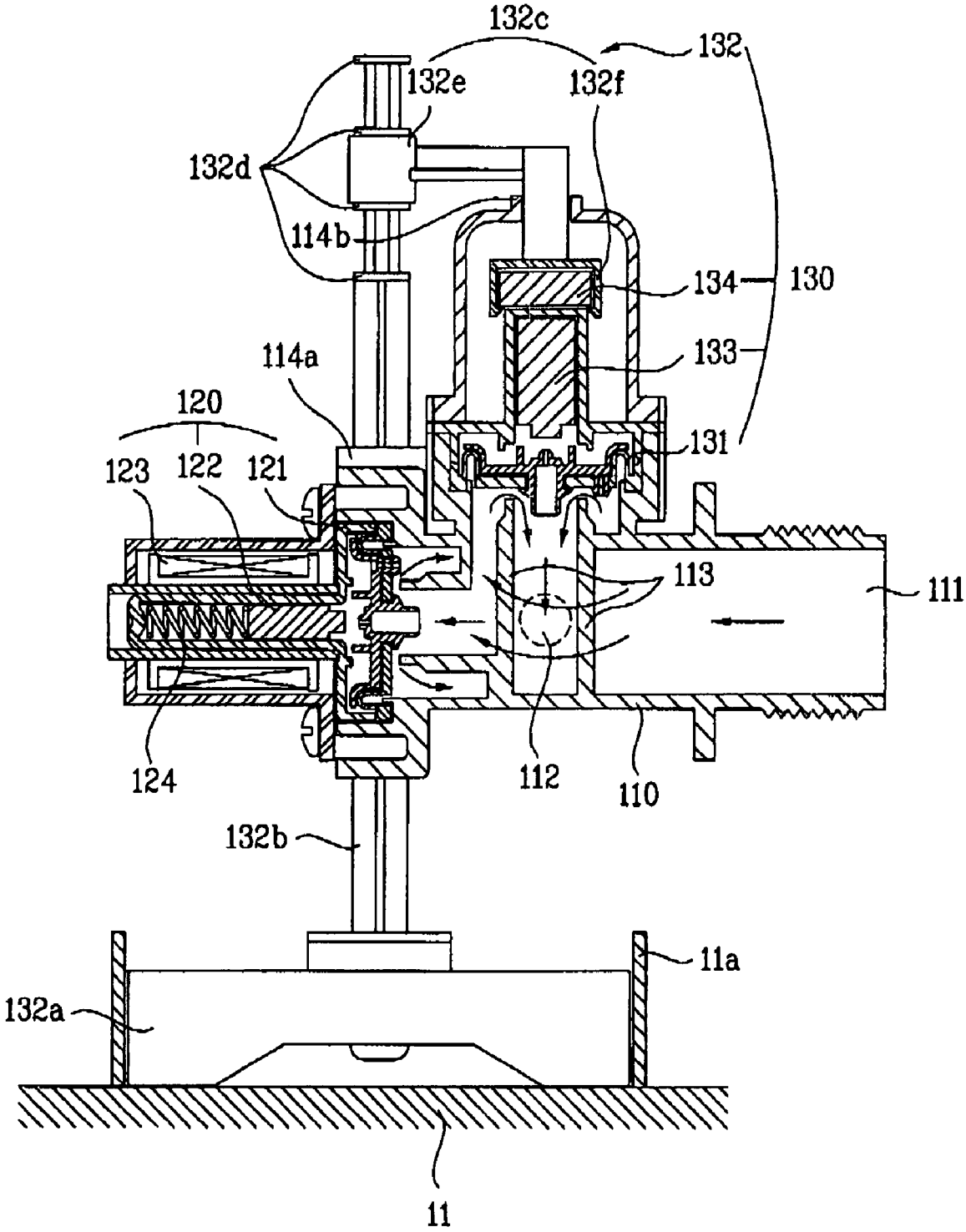

FIG. 3 is a perspective view of a disassembled inlet valve assembly of a dishwasher according to the present invention, FIG. 4 is a perspective view of a dishwasher according to the present invention, and FIG. 5A and FIG. 5B are cross-sectional views of a dishwasher according to the present invention.

Referring to FIG. 3, an inlet valve assembly 100 is disposed in a lower part of the dishwasher. Specifically, the inlet valve assembly 100 is installed between a base panel 11 of the housing 10 and the tub 20. The inlet valve assembly 100 is installed at a lower part of a rear panel 12 of the housing 10 using a coupling member. And, the inlet valve assembly 100 mainly includes a case 110 and first and second valve 120 and 130 installed in the case 110.

The case 110 includes an inlet opening 111 via which water flows in and an outlet opening 112 via which the flowing in water is discharged. The outlet and inlet openings 112 and 111 are provided to the case 110 to lie inside and outside the rear panel 12, respectively. A predetermined passage is formed inside the case 110 for controlling a flow of water. A partition wall 113, a shown in FIG. 5B, is formed in the case 110 to enclose a periphery of the outlet opening 112. Hence, the water, which is indicated by arrows in the drawing, detours the partition wall 113 to flow to the first valve 120 via the inlet opening 111, and then flows to the outlet opening 112 via the passage between the second valve 130 and the partition wall 113.

Figure 5C:
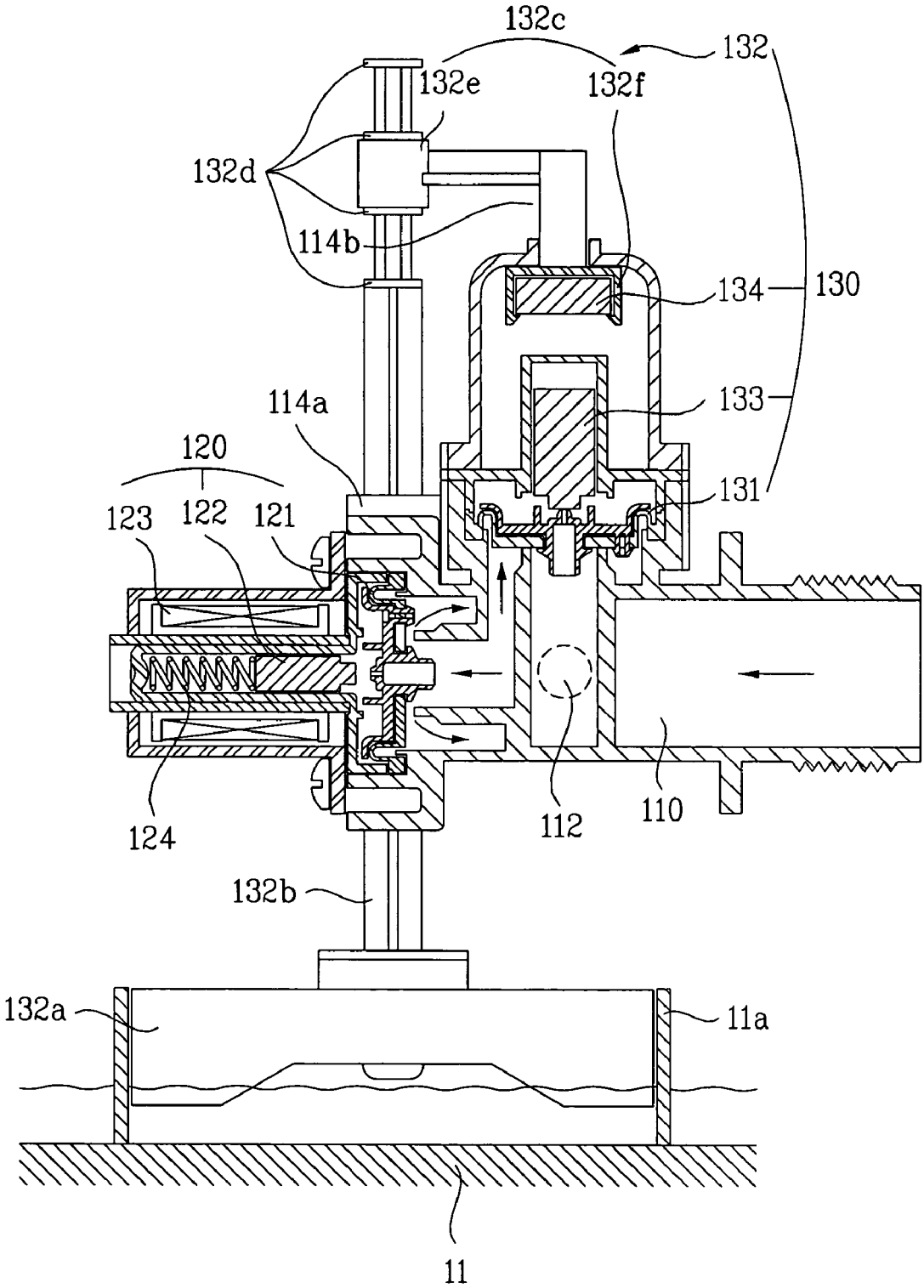

The first valve 120 is installed in the case 110 to control the supply of water. For this, the first valve 120 is configured to selectively open/close the passage in the case 110, and substantially, the neighboring inlet opening 111. The first valve 120, as shown in FIGS. 5A to 5C, includes a diaphragm 121, a plunger 122 near the diaphragm 121, and a solenoid 123. The diaphragm 121 is installed on the passage in the vicinity of the inlet opening 111. The plunger 122 supported by a spring 124 presses the diaphragm 121. Namely, the diaphragm 121 is pushed to adhere closely to the passage by the plunger 122 to close the passage. The solenoid 123 is installed around the plunger 122 to leave a predetermined distance. When a current is applied to the solenoid 123, the solenoid 123 generates a magnetic field to pull the plunger 122 not to press the diaphragm 121. Hence, once the current is applied to the solenoid 123 by a controller (not shown in the drawing) controlling an operation of the dishwasher, the generated magnetic field enables the plunger 122 to overcome the elastic force of the spring 124 to release the diaphragm 121. Thereafter, the diaphragm 121 opens the passage by a water pressure so that water starts to be supplied to the dishwasher.

The second valve 130 is configured to close the passage in the case 110 if water leaks. Specifically, if a predetermined amount of water leaks on the base panel 11, the second valve 130 substantially closes the neighboring oudet opening 112. The second valve 130, as shown in FIG. 4 to FIG. 5C, includes a diaphragm 131 and a pressing mechanism configured to press the diaphragm 131. The diaphragm 131 is installed at the passage in the vicinity of the outlet opening 112. Moreover, the pressing mechanism floats on the leaking water to press the diaphragm 131 to close the passage. Such a pressing mechanism is explained in detail as follows.

The pressing mechanism includes a float 132 configured to be floated by the leaking water and a plunger 133 configured to press the diaphragm 131 by the floated float 132. The plunger 133 enables to press the diaphragm 131 in various ways related to the floatage of the float 132. In the present invention, the plunger 133 is separated from the floated float 132 to press the diaphragm 131. Such a method is preferable because the configuration of the relating valve assembly is simplified. Moreover, the float 132 ascends or descends so that a relative distance between the float 132 and the plunger 133 is variable. Hence, such a variable distance facilitates to control the separation of the plunger 133. For this, the pressing mechanism further includes a magnet 134 generating a magnetic field attracting the plunger 133. The magnet 134 is installed at the float 132 in the vicinity of the plunger 133, whereas the plunger 133 is installed in the case 110 in the vicinity of the diaphragm 131 to be movable. Hence, if there is no leakage of water, the plunger 133 is attracted to the adjacent magnet 134 so as not to press the diaphragm 131. On the other hand, once the magnet 134 is separated by the floatage of the float 132, the plunger 133 is separated from the magnet 134 to press the adjacent diaphragm 131. Hence, the magnet 134 separates the plunger 133 according to the distance from the plunger 133.

The float 132 is configured to be substantially floated by the water leaking on the base panel 11. Specifically, the float 132 includes a body 132*a* floated by the leaking water and an extension member extending from the body 132*a* to be adjacent to the plunger 133.

The body 132*a* of the float 132 lies on the base panel 11 and is floated by the water leaking on the base panel 11. The body 132*a* is substantially a disc type and is formed of a lightweight material such as Styrofoam and the like. Moreover, the body 132*a* is installed between a plurality of guides 11*a* protruding from the base panel 11, and is guided by the guides 11*a* to stably move upward and downward. Namely, the guides 11*a* substantially lead the overall movement of the float 132.

The extension member includes a rod 132*b* installed at the body 132*a* and an arm 132*c* extending from the rod 132*b*. The magnet 134 is installed at the extension member to be in the vicinity of the plunger 133. First of all, the rod 132*b* extends vertically from a center of the body 132*a*. The rod 132*b*, as well shown in FIG. 4, is installed to penetrate a first holder 114*a* provided in the case 110, thereby being guided by the first holder 114*a* on moving upward and downward. The first holder 114*a* substantially has a hole of which diameter is greater than that of the rod 132*b* so as to be penetrated by the rod 132*b*. The arm 132*c* extends to the plunger 133 from the rod 132*b* and is then bent to be adjacent to the plunger 133. The magnet 134 is substantially installed at the arm 132*c* of the extension member. A second holder 114*b* is installed on a top of the case 110 and includes a hole in which the bent portion of the arm 132*c* is inserted. An opening 114*c* is formed at a side of the second holder 114*b*, and the bent portion is easily loaded in or unloaded from the second holder 114*b* via the opening 114*c*. The bent portion is guided by the second holder 114*b*, whereby the float 132 as well as the arm 132*c* enables to stably move upward and downward overall.

Specifically, a first end 132*e* of the arm 132*c* is installed at the rod 132*b* movably and detachably. For this, the first end 132*e*, as shown in FIG. 4, has an open ring shape of which one portion is cut away so as to be elastically deformed to be freely detachable from the rod 132*b*. Moreover, a step 132*d* is formed at the rod 132*b* to support the attached first end 132*e* stably. Preferably, a plurality of steps 132*d* can be formed at the rod 132*b* to leave a predetermined interval from each other. The steps 132*d* divide the rod 132*b* into a plurality of sections, and the first end 132*e* is loaded at one of the sections. Namely, the steps 132*d* enable the arm 132*c* to be selectively loaded on a demanded position at the rod 132*b*. Hence, the arm 132*c* is movably installed at the rod 132*b* to adjust a distance between the magnet 134 and the plunger 133. Such a distance adjustment enables to control an operational sensitivity of the second valve 130. For instance, when the first end 132*e* is relatively installed at an upper part of the rod 32*b*, the magnet 134 relatively gets far from the plunger 133. Hence, even if the float 132 floats a little, the plunger 133 is released from the magnet 134 to press the diaphragm 131. Namely, despite a small amount of the leaking water, the second valve 130 is turned off to close the passage. Meanwhile, a plurality of hooks are provided to a second end 132*f* of the arm 132*c* so that the magnet 134 can be stably installed at the second end 132*f* by the hooks.

An operation of the dishwasher according to the present invention is explained by referring to the relating drawings as follows.

First of all, the water is not supplied to the dishwasher via the valve assembly 100 and the inlet passage 51 until the dishwasher operates. The plunger 122 of the first valve 120, as shown in FIG. 5A, presses the diaphragm 121 by the elastic force of the spring 124, and the pressed diaphragm 121 then closes the passage in the vicinity of the inlet opening 111. As the inlet opening 111 is substantially closed by the first valve 120, the water is unable to pass the valve assembly 100 to be supplied to the dishwasher.

Once a user starts to operate the dishwasher, the controller of the dishwasher executes a water supply according to a setup washing course. Namely, a current is applied to the solenoid 123 of the first valve 120 by the controller. A magnetic field appearing around the solenoid 123 enables the plunger 122, as shown in FIG. 5B, to overcome the elastic force of the spring 123 to be drawn toward the solenoid 123. Simultaneously, as the force pressing the diaphragm 121 is released, the diaphragm 121 is pulled by the water pressure to open the inlet opening 111.

Moreover, in the second valve 130, since the distance between the plunger 133 and the magnet 134 is short, the plunger 133 is attached to the magnet 134 by interposing the case 110 therebetween. Hence, the plunger 133 fails to press the diaphragm 131 so that the outlet opening 112 is kept open as well.

As both of the inlet and outlet openings 111 and 112 are open, the water is supplied to the sump 42 via the valve assembly 100 and the inlet passage 51.

Referring to FIG. 2, the supplied water is pumped up by the pump 43 and is then injected onto the tableware in the rack 30 via the nozzle 41. Thus, the tableware is washed by the injected water. In the proves of washing the tableware, excessive water supply or failure of the inlet passage 51 or valve assembly 100 may cause the leakage of the water. And, the leaking water gathers on the base panel 11. Since the dishwasher keeps washing, the plunger 122 of the first valve 120, as shown in FIG. 5B, fails to press the diaphragm 121 thereof so that the inlet opening 11 keeps open.

Yet, in the second valve 130, the body 132*a* is floated by the leaking water as soon as the rod 132*b* and the arm 132*c* ascend together with the magnet 134. The plunger 133 gets away from the magnet 134 by such an ascending movement to deviate from an effective range of the magnetic field of the magnet 134, thereby being separated from the magnet 134 to move downward by gravity. Hence, the plunger 133 presses the diaphragm 131 to close the outlet opening 112.

As the inlet opening 111 and the outlet opening 112 are open and closed, respectively, the water is not supplied to the dishwasher any more. Hence, the water is prevented from leaking in addition.

Consequently, the valve assembly according to the present invention utilizes a mechanism and enables to independently stop supplying water without interworking with other peripheral devices when the water leakage takes place. Therefore, the valve assembly according to the present invention is directly applicable to other home appliances using water such as a washing machine and the like without modification.

Accordingly, the dishwasher according to the present invention has the following advantages or effects.

First of all, the inlet valve assembly includes the second valve operating to close the internal passage using the leaking water. Moreover, the second valve enables to independently stop supplying the water, thereby stably preventing additional water leakage when the water leaks. Therefore, the present invention prevents accidents such as an electric shock, fire etc., as well as failures or malfunctions of electric devices, thereby enhancing its stability, reliance, and safety.

Moreover, the second valve mechanically operates using the float, magnet, and the like, whereby the valve assembly is simply configured. And, the mechanical second valve enables the valve assembly to operate to stop supplying the water more accurately than other electronic mechanisms affected by the leaking water. Therefore, the present invention reduces a product cost and enhances reliance more.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A dishwasher, comprising:

a housing;

a tub provided in the housing;

an injector assembly configured to inject water onto tableware positioned in the tub; and an inlet valve assembly, comprising:

a case provided at an inlet supply passage that supplies water to the tub, wherein the case comprises an inlet opening through which water flows into the case, and an outlet opening through which water is discharged from the case;

a first valve provided in the case and configured to selectively open and close a passage formed in the case; and a second valve provided in the case and configured to close the passage when a leak is detected, wherein the second valve comprises:

a diaphragm installed at the passage; and a pressing mechanism that selectively presses on the diaphragm to close the passage, wherein the pressing mechanism comprises:

a float configured to float on accumulated water in the housing; and a plunger separate from the float and configured to press on the diaphragm when the float floats to a predetermined height on the accumulated water.

2. The dishwasher as claimed in claim 1, wherein the case is provided at a lower portion of a rear panel of the housing.

3. The dishwasher as claimed in claim 1, wherein the first valve is configured to selectively open and close the inlet opening in the case.

4. The dishwasher as claimed in claim 1, wherein the second valve is configured to close the outiet opening in the case.

5. The dishwasher as claimed in claim 1, wherein the second valve is configured to close the passage based on an amount of water accumulated on a base panel of the housing.

6. The dishwasher as claimed in claim 1, wherein the plunger presses on or does not press on the diaphragm based on a distance between the plunger and an end of an arm coupled to the float.

7. The dishwasher as claimed in claim 1, the pressing mechanism further comprising a magnet attached to an end of an arm coupled to the float, wherein the magnet is configured to detachably engage with the plunger based on a distance between the magnet and the plunger.

8. The dishwasher as claimed in claim 7, the float comprising:

a body configured to float on accumulated water in the housing; and an extension member extending from the body and into the case, to a position adjacent to the plunger in the case.

9. The dishwasher as claimed in claim 8, wherein the body is formed of Styrofoam.

10. The dishwasher as claimed in claim 8, wherein the extension member comprises a rod extending from the body and an arm extending from the rod to a position adjacent to the plunger.

11. The dishwasher as claimed in claim 10, wherein the arm is movably coupled to the rod.

12. The dishwasher as claimed in claim 10, wherein the magnet is provided on the arm.

13. The dishwasher as claimed in claim 10, wherein the rod comprises at least one step configured to support the arm.

14. The dishwasher as claimed in claim 10, wherein the rod comprises a plurality of steps to selectively couple the arm to corresponding predetermined portions of the rod.

15. The dishwasher as claimed in claim 8, wherein the magnet is provided on the extension member, in a position proximate to the plunger.

16. The dishwasher as claimed in claim 1, further comprising a guide provided on a base panel of the housing and configured to guide movement of the float.

17. The dishwasher as claimed in claim 1, wherein the case comprises a holder configured to guide a movement of the float.

18. An inlet valve assembly, comprising:

a case provided at an inlet passage configured to supply water, wherein the case comprises an inlet through which water flows in and an outlet through which water is discharged;

a first valve provided within the case and configured to selectively open and close a passage formed in the case; and a second valve configured to close the passage when a leak is detected, wherein the second valve comprises:

a diaphragm installed at the passage; and a pressing mechanism configured to press on the diaphragm to close the passage, wherein the pressing mechanism comprises:

a float configured to float on water accumulated from a leak; and a plunger separate from the float and configured to press on the diaphragm when the float rises to a predetermined height on the accumulated water.

19. The inlet valve assembly as claimed in claim 18, wherein the case is installed at a lower portion of a rear panel of a housing of a home appliance.

20. The inlet valve assembly as claimed in claim 18, wherein the first valve is configured to selectively open and close the inlet.

21. The inlet valve assembly as claimed in claim 18, wherein the second valve is configured to close the outlet.

22. The inlet valve assembly as claimed in claim 18, wherein the second valve is configured to close the passage based on a level of water accumulated on a base panel of a housing of a home appliance.

23. The inlet valve assembly as claimed in claim 18, wherein the plunger is configured to press on or not press on the diaphragm based on a distance between the plunger and an arm extending from the float.

24. The inlet valve assembly as claimed in claim 23, the float comprising:

a body configured to float on the accumulated water; and an extension member extending from the body to a position adjacent to the plunger in the case.

25. The inlet valve assembly as claimed in claim 24, wherein the body is formed of Styrofoam.

26. The inlet valve assembly as claimed in claim 24, wherein the extension member comprises a rod extending from the body and an arm extending from the rod to a position adjacent to the plunger.

27. The inlet valve assembly as claimed in claim 26, wherein the arm is movably coupled to the rod.

28. The inlet valve assembly as claimed in claim 26, wherein the magnet is provided on the arm.

29. The inlet valve assembly as claimed in claim 26, wherein the rod comprises at least one step configured to support the arm.

30. The inlet valve assembly as claimed in claim 26, wherein the rod comprises a plurality of steps configured to selectively couple the arm to corresponding predetermined portions of the rod.

31. The inlet valve assembly as claimed in claim 24, wherein the magnet is provided on the extension member in a position proximate to the plunger.

32. The inlet valve assembly as claimed in claim 18, the pressing mechanism further comprising a magnet mounted on an arm extending from the float and configured to detachably engage the plunger based on a distance between the magnet and the plunger.

33. The inlet valve assembly as claimed in claim 18, further comprising a guide provided on a base panel of a housing of a home appliance and configured to guide the float.

34. The inlet valve assembly as claimed in claim 18, wherein the case comprises a holder configured to guide a movement of the float.

35. A dishwasher, comprising:

a housing;

a tub provided in the housing;

a nozzle assembly configured to direct washing fluid onto items in the tub; and a valve assembly configured to control a flow of washing fluid into the tub, the valve assembly comprising:

a case having an inlet through which washing fluid is introduced into the case, and an outlet through which water is discharged from the case;

a passage extending between the inlet and the outlet;

a first valve configured to selectively open and close the inlet formed in the case; and a second valve configured to selectively open and close the outlet formed in the case based on an amount of water accumulated in the housing comprises:

a diaphragm installed in the passage; and a pressing mechanism, comprising:

a float configured to float on water accumulated on a base panel of the housing, the float having an extension member that extends to a position adjacent the second valve; and a plunger configured to press on the diaphragm when the float floats on the accumulated water, wherein the plunger is configured to press on or not press on the diaphragm based on a distance between the plunger and the extension member of the float.

36. The dishwasher of claim 35, wherein the extension member of the float comprises:

a rod extending from the body; and an arm movably coupled to the rod and extending from the rod to a position adjacent to the plunger.

37. The dishwasher of claim 36, wherein a magnet is mounted on an end of the arm such that it is positioned adjacent the plunger.

38. The dishwasher of claim 37, wherein when the level of accumulated water is low, the magnet is positioned close to the plunger and an attractive force of the magnet holds the plunger in a position where it does not press on the diaphragm, thus keeping the second valve open.

39. The dishwasher of claim 38, wherein if the amount of accumulated water is great, the magnet moves away from the plunger, thereby releasing the plunger such that the plunger presses on the diaphragm, thereby closing the second valve.

* * * * *